US005082281A

United States Patent [19]

Berghofer

[11] Patent Number: 5,082,281

[45] Date of Patent: Jan. 21, 1992

[54] SPORTS TIMING AID

[76] Inventor: Charles C. Berghofer, 406 San Antonio Rd., Arcadia, Calif. 91006

[21] Appl. No.: 597,387

[22] Filed: Oct. 15, 1990

[51] Int. Cl.[5] ..... A63B 69/36

[52] U.S. Cl. ..... 273/183 R; 273/183 B; 273/26 C; 273/29 A; 273/32 H; 340/323 R; 434/252

[58] Field of Search ..... 273/26 C, 29 A, 183 B, 273/183 R, 32 R, 32 B, 32 H, 35 R, 186 R, 25, 26 R, 29 R, 440, 445; 272/70, 72, DIG. 9; 340/309.15, 323 R; 434/252, 255, 257

[56] References Cited

U.S. PATENT DOCUMENTS

| | | | |
|---|---|---|---|
| 3,772,800 | 11/1973 | Seze | 434/252 |
| 3,893,099 | 7/1975 | Zoepfl | 340/323 R |
| 3,915,457 | 10/1975 | Casey | 434/252 |
| 4,164,732 | 8/1979 | Pischiera | 340/323 R |
| 4,193,257 | 3/1980 | Watkins | 340/384 E |
| 4,204,400 | 5/1980 | Morohoshi et al. | 340/384 E |
| 4,280,123 | 7/1981 | Right et al. | 340/384 E |
| 4,283,712 | 8/1981 | Goody | 340/323 R |
| 4,302,752 | 11/1981 | Weitzler | 340/309.15 |
| 4,343,990 | 8/1982 | Ueda | 340/384 E |
| 4,491,423 | 1/1985 | Cohen | 340/309.15 |
| 4,840,371 | 6/1989 | Harris | 273/162 R |
| 4,872,687 | 10/1989 | Dooley | 273/185 R |

FOREIGN PATENT DOCUMENTS

| | | | |
|---|---|---|---|
| 2175508 | 12/1986 | United Kingdom | 434/255 |

*Primary Examiner*—Edward M. Coven
*Assistant Examiner*—Jessica J. Harrison
*Attorney, Agent, or Firm*—Allan M. Shapiro

[57] ABSTRACT

An assistance device for sports training of sports requiring rhythmic activity. Audible prompts are delivered to the user so that he or she knows when to engage in a certain activity of the sport, the primary example being that of the golf club stroke. A clock provides a sequence of pulse signals at a constant time interval, with the interval being adjustable by the user. Multiple sound generators selectably receive the clock signals and generate corresponding audible sounds. A timing sequence controller correlates the multiple sound generators for the training effect. A visual display is included to give the user rapid understanding of how the device is used.

22 Claims, 2 Drawing Sheets

FIG. 2
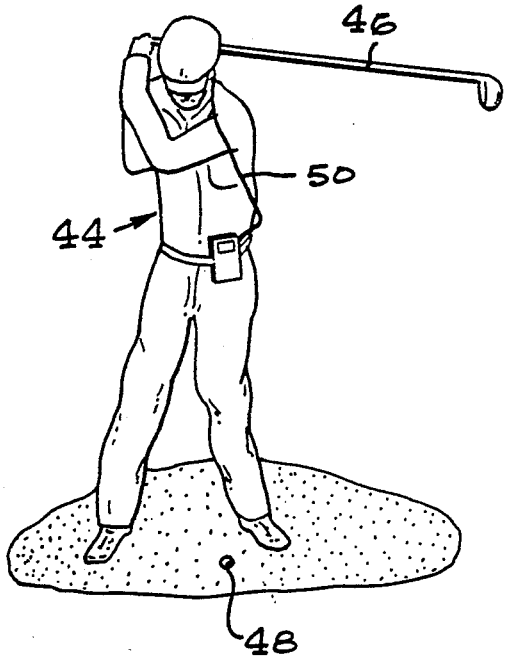
FIG. 3
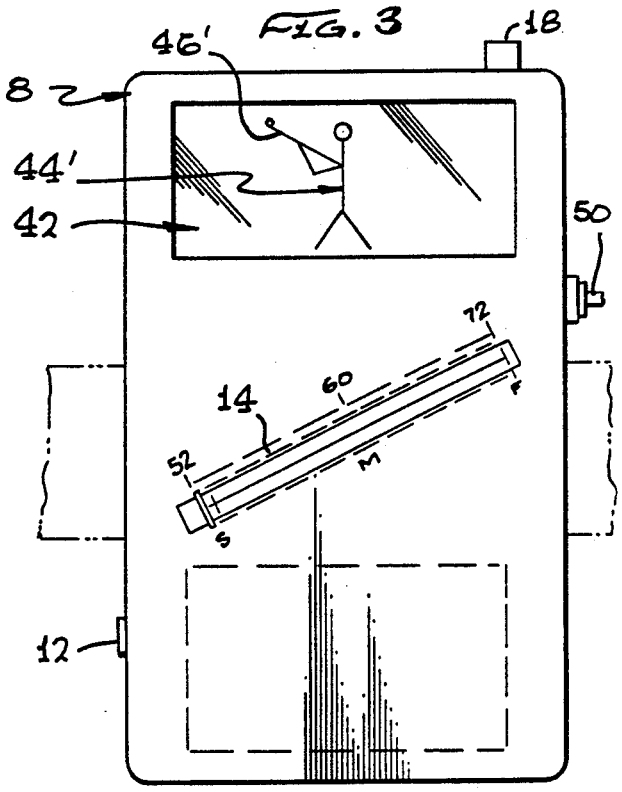
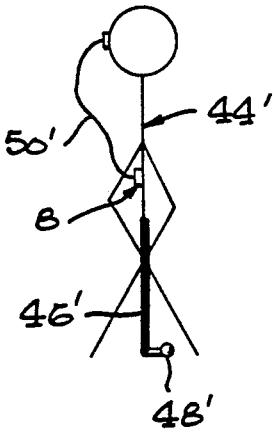
FIG. 4A
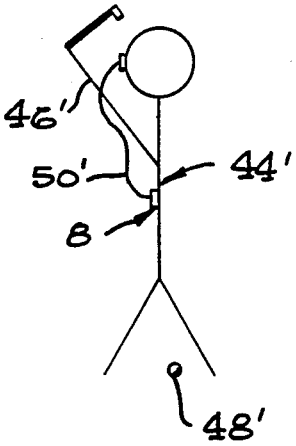
FIG. 4B
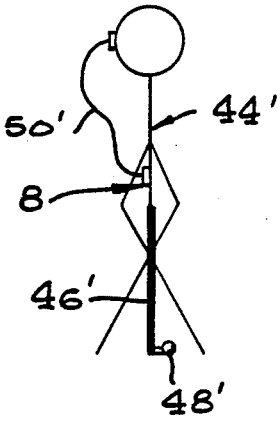
FIG. 4C

SPORTS TIMING AID

BACKGROUND OF THE INVENTION

1. Field of the Invention

This invention is directed to the improvement of performance in rhythmic sports activities, particularly golf, through audible prompting of the user thereof. A visual display showing a stick golfing figure is included to facilitate golfing use.

2. Description of the Prior Art

The game of golf is a gentle sport of men and women throughout the world. However, the sport's amiable nature belies the challenge that awaits those who engage in golf for recreation. Hitting a small ball very hard with a stick as far and as accurately as one can into a small hole in the ground hundreds of yards away proves to be a challenge even to the most accomplished golfer.

For this reason, many inventors have constructed means by which the most important part of the game, the golf stroke, can be improved.

Visual aids in improving the golf swing have a long history and are known in the art. Richter's INSTRUCTION DEVICE, U.S. Pat. No. 1,558,762 is an example of a mirror system with accompanying pictures of proper golf swing form. Casey's INSTRUCTION DEVICE, U.S. Pat. No. 3,915,457 integrates visual form cues superimposed upon a convex mirror.

Devices have been incorporated into sports equipment in order to help the athlete improve his/her performance by rewarding the athlete by responding to proper activity. Barthol's PSYCHOLOGICAL TRAINING DEVICE FOR A SPORT, U.S. Pat. No. 3,436,076 emits a visible flash of light when a baseball or golf ball is correctly hit. Davis, GOLF SWING PRACTICE CLUB, U.S. Pat. No. 3,575,419, gives a satisfying click when the practice club is properly swung.

Other means are also available to the golfer to improve the swing of the golf club. Lorang's GOLF SWING WRIST ACTION TRAINING APPARATUS, U.S. Pat. No. 4,023,812 discloses a physical attachment to the golfer's club in order to help the golfer properly move the wrists. While the movement (cocking and uncocking) of the wrists is a significant portion of the golf swing, Lorang does not deal with the significant motion of the arms, legs, hips, shoulders, torso and head.

In Fink's PHYSICAL TRAINING SYSTEM, U.S. Pat. No. 3,808,707, there is disclosed a device to train both muscular activity and muscular exertion by varying respectively frequency and intensity of an audible signal. Not only does Fink's system require pre-programming, but it is useful almost exclusively to one, unique individual, preventing the sharing of such a device as there is no possible adjustment of the emitted audio signal. Also, Fink is not goal directed as it does not signal certain actions being accomplished (such as the end of a golfer's backswing), but instead is more directly related to the process of the golf swing, prompting certain activity directly, namely, muscle activity and exertion.

All of the aforementioned U.S. patents have some bearing on the art of improving a golfer's swing. However, none of them directly addresses the crucial element of the timing of the golfer's swing. The sports timing aid disclosed and claimed herein addresses that omission while also allowing flexible application to non-golf related, yet rhythmic, sports activities.

In many sports, rhythmic activity acts as a basis for the recreation or sport engaged in. This is true for golf, tennis, bowling, bicycling, jogging and aerobics. Further, engaging in or strictly following a rhythm during sports play may enhance performance in sports activities. When an athlete can easily follow the natural rhythm his or her body engages in when in competition or while playing the sport, performance may be enhanced and subsequent enjoyment of the game or sport increased. Audible prompting of the athlete or player through rhythmic signals is a means of accomplishing this.

In golfing, many players experience inhibited performance due to poor golf club swings resulting from poor form in swinging the golf club. Poor form in golf club swings can result from the lack of rhythmic swinging of the golf club.

When a golf club is swung properly, the time of the backswing is the same as the time of the foreswing to the moment of impact of the golf club with the ball. Many golfers may take too short of a back swing or rush their foreswing such that the golf club swing as a whole is out of kilter. This results in poor golf ball control and poor driving of the golf ball down the course, as well as much frustration on the part of the golfer.

Conscious effort on the part of the golfer to achieve a rhythmically balanced club swing may be very elusive without being much help. The sports timing aid disclosed herein allows the golfer to more easily attain a temporally balanced golf club swing, thereby enhancing performance and satisfaction with the game.

For tennis, the serve of the tennis ball is very much like that of the drive of the golf ball in golfing. The backswing of the service and the time from the end of the backswing to impact with the tennis ball should be the same. In order to help maintain that rhythmic constancy, the sports timing aid can be used to help those who have poor tennis service swings.

Likewise, for bowling as in golf and tennis, the delivery of the bowling ball down the bowling alley comprises a rhythmic swing that can be improved by the sports timing aid when the delivery is rushed or unbalanced.

In bicycling, rhythmic pedal strokes can enhance the speed of the rider as well as condition the rider as when the same rhythm is maintained along a long level path or while climbing an incline. Due to the distractions of the rider's physical effort, surrounding and/or inattentiveness, it may be difficult for a bicyclist to maintain a rhythm while cycling. Use of a sports timing aid such as the one disclosed allows the bicyclist to overcome these obstacles while riding a bicycle.

As for bicycling, joggers and runners can use the sports timing aid to enhance performance by maintaining a rhythmic stride while overcoming distractions that tend to break rhythm in the stride.

As for bicycling and running, aerobic activity and low impact exercise may be enhanced by following a consistent rhythm that would otherwise be difficult to maintain in the face of fatigue.

As the game of golf enjoys a well-established history, many prior art attempts at helping the golfer achieve his/her optimum swing exist. However, none of these allow the golfer the advantageous combination encompassed by the sports timing aid disclosed herein. Further, such prior art devices generally do not have applications outside the sport of golf as does the sports timing aid of this invention. In conclusion, whatever the precise merits, features and advantages of the above cited references, none of them achieves or fulfills the purposes of the sports timing aid of the current invention.

SUMMARY OF THE INVENTION

In order to aid in the understanding of this invention, it can be stated in essentially summary form that it is directed to an apparatus for creating rhythmic audible signals to direct or prompt an athlete while engaging in rhythmic sports activities. The apparatus comprises an adjustable clock that drives audible signal generators and controllers so that the signal can be tailored to the athlete and his/her needs, an earphone or speaker through which the rhythmic audible signals are transmitted to the athlete, and a visual display for golfers so that they might easily and readily understand how to use the sports timing aid in order to improve their golfing by maintaining a consistently rhythmic golf club swing. Accordingly, it is an object of this invention to provide an apparatus to audibly signal or prompt an athlete when to engage in an element of rhythmic activity that comprises his sport. It is another object of this invention to provide such an apparatus that is both highly portable and unitary in design and construction. Another object of this invention is to provide the athlete with control over the rhythm of the audible signals generated by the sports timing aid. Another object of this invention is to provide the athlete with appropriate audible signals for his specific sport. Another object of this invention is to provide different types of audible signals and/or signal groups for different sports and to allow the user athlete control over these different types of audible signals and signal groups. It is another object of this invention to provide golfers who use the sports timing aid an easily recognizable representation of the golf stroke to be engaged in by the golfer while using the device.

The features of the present invention which are believed to be novel are set forth with particularity in the appended claims. The present invention, both as to its organization and manner of operation, together with further objects and advantages thereof, may be understood best by reference to the following description taken in connection with the accompanying drawings.

BRIEF DESCRIPTION OF THE DRAWINGS

FIG. 2 is a frontal view of a golfer in mid-swing using the sports timing aid of this invention which is attached to the golfer's belt.

FIG. 3 is a frontal view of the sports timing aid as it would appear attached to a wearer's belt showing the on/off switch, the start switch, the visual display, the variable control, and the earphone speaker outlet.

FIGS. 4A, 4B, and 4C show in temporal order a stick figure representing a golfer using the sports timing aid from the start of the swing of the golf club, FIG. 4A, to the end of the back swing, FIG. 4B, to the moment of the foreswing just before the golf ball is struck by the club and the golfer begins to follow through on his stroke, FIG. 4C.

DETAILED DESCRIPTION OF THE PREFERRED EMBODIMENT

Figure 1:
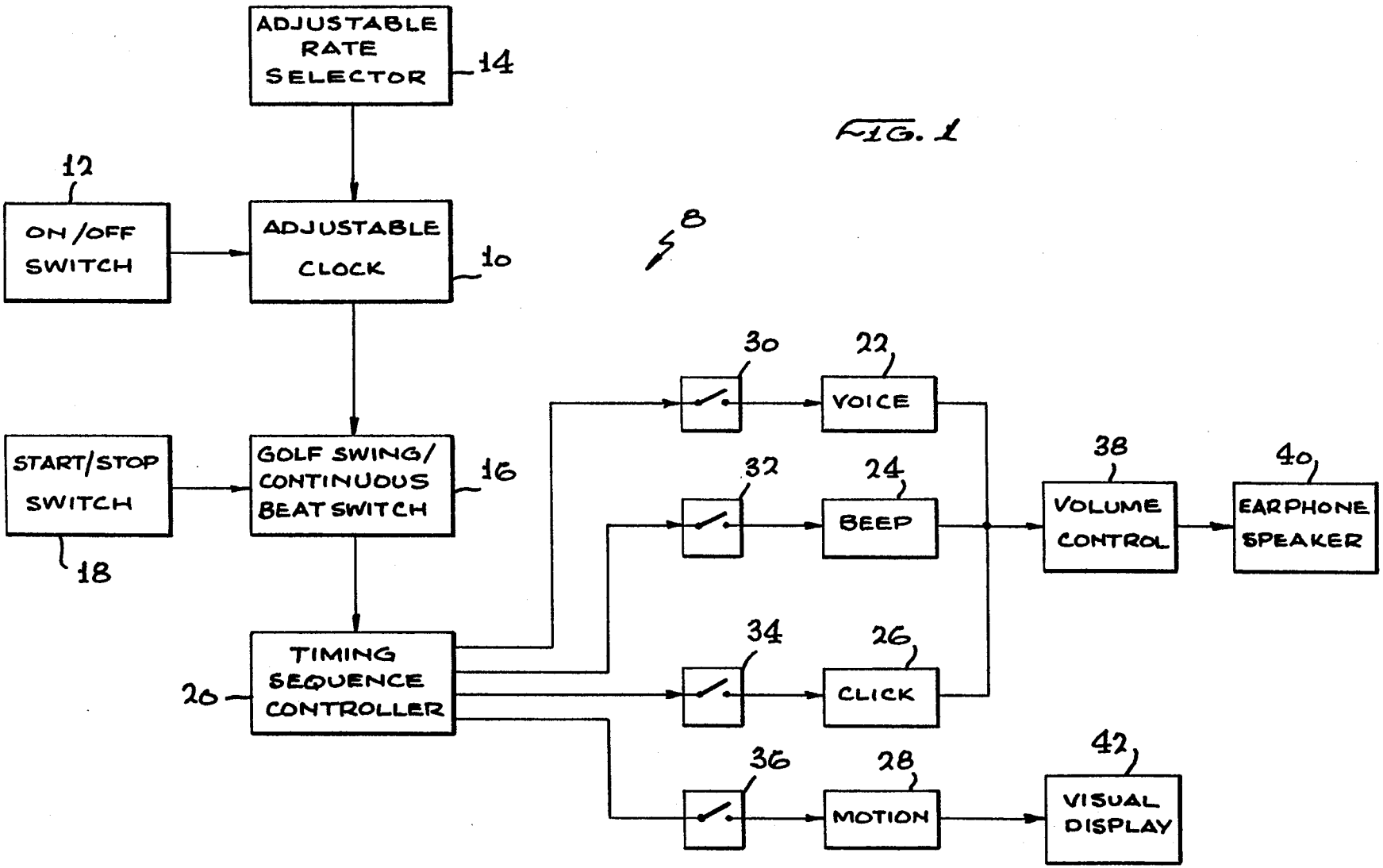
FIG. 1 is a block and schematic diagram representing the various components and switches functioning together in the sports timing aid.

The sports timing aid 8 disclosed herein is a device that prompts the wearer when to engage in the rhythmic activity of the sport being played. In the preferred embodiment illustrated, the sports timing aid 8 has its most dramatic results with the stroke of the golf club in the game of golf and is described in connection therewith.

At the core of the sports timing device is an adjustable clock 10, which is turned on and off by means of an on/off switch 12. The clock 10 produces timing signals at an adjustable rate determined by the adjustable rate selector 14.

The adjustable clock 10 has a single output that is connected to an input of a golf swing/continuous beat switch 16. Also connected to the golf swing/continuous beat switch 16 is a start/stop switch 18. The output of the golf swing/continuous beat switch 16 is connected to the input of a timing sequence controller 20. The timing sequence controller 20 has four outputs, one for each of the voice 22, beep 24, and click 26 signal generators, and one for the motion simulation signal generator 28. The timing sequence controller 20 is coupled to the audible and motion simulation signal generators 22, 24, 26 and 28 through respective connecting switches 30, 32, 34 and 36.

The output signals of the audible signal generators 22–26 are supplied through a volume control 38 to an earphone or speaker 40 or other transducer that produces sounds from electric signals.

The output signals of the motion simulation signal generator 28 are supplied to a visual display 42.

The operation of the sports timing aid 8 will become clear from the following description.

Power is supplied to the sports timing aid 8 when the on/off switch 12 is turned "on". Power is supplied by a battery (not shown) that may be rechargeable. When the sports timing aid 8 is turned "on", the adjustable clock 10 commences to emit timing signals that are the same length of time apart, i.e., a time interval. This time interval is adjusted by the adjustable rate selector 14. The timing signals emitted by the adjustable clock 10 are fed to the golf swing/continuous beat switch 16

The golf swing/continuous beat switch 16 controls the further transmission of timing signals to the timing sequence controller 20, which allows the timing sequence controller 20 to signal the appropriate signal generators at the appropriate time.

The golf swing/continuous beat switch 16 is provided with the start/stop switch 18. Depending on the mode of operation of the golf swing/continuous beat switch 16, the start/stop switch 18 has different effects on the sports timing aid 8. When the golf swing/continuous beat switch 16 is in the golf swing position, the start/stop switch 18 initiates the golf swing sequence when first pressed. If the user desires to re-initiate the golf swing sequence, the start/stop switch 18 is pressed again.

If the golf swing/continuous beat switch 16 is in the continuous beat mode, then the start/stop switch 18 acts as a toggle for the sports timing aid 8. When the start/stop switch 18 is pressed once, the golf swing/continuous beat switch 16 allows further transmission of the timing signals emitted by the adjustable clock 10 to the timing sequence controller 20. The sports timing aid 8 then generates tone signals and tones on an ongoing continuous basis. If the start/stop switch 18 is pressed again, the golf swing/continuous beat switch 16 prevents further transmission of the timing signals emitted from the adjustable clock 10 and the sports timing aid 8 falls silent until the golf swing/continuous beat switch 16 is pressed again.

The output of the golf swing/continuous beat switch 16 is connected to the input of the timing sequence controller 20. The timing sequence controller 20 controls the further transmission of signals passed by the golf swing/continuous beat switch 16 to the signal generators 22–28. Like the start/stop switch 18, the timing sequence controller 20 has a different effect on the sports timing aid 8 depending upon the position of the golf swing/continuous beat switch 16.

If the golf swing/continuous beat switch 16 is in the golf swing mode, then the timing sequence controller 20 emits the signals in the appropriate sequence for the golf swing. Thus, these signals are pulses to the beep, click, and voice signal generators 22–26 and pulses to the motion simulation signal generator 28. Upon initiation of the golf swing cycle by the start/stop switch 18, the timing sequence controller 20 delays for approximately five seconds before emitting any pulses. Upon the passing of approximately five seconds, the timing sequence controller 20 passes two sequential signals to the beep signal generator 24. The next two sequential signals are passed simultaneously to the click signal generator 26 and the voice signal generator 22. The timing sequence controller 20 then passes no signals until either the golf swing sequence is initiated again by the start/stop switch 18 or the continuous beat mode is engaged.

In alternative configuration (not shown), for example, the timing signals from the adjustable clock 10 may be supplied directly to the timing sequence controller 20. In this case, the golf swing/continuous beat switch 16, with its start/stop switch 18, may be coupled separately and in parallel to the timing sequence controller 20 for independent control of transmission of the timing signals.

Connected to the timing sequence controller's 20 four outputs are four switches 30–36, one switch connected to each output. These switches enable the user to control the output of the sports timing aid 8 by allowing the user to permit or prevent the transmission of pulses to the four signal generators 22–28. The output of each switch is connected to the input of a single signal generator. The user then has selectable control over which of the signal generators 22–28, and accompanying sound emitter 40 or visual display 42, are active.

Connected to the output of the first switch 30 is a voice signal generator 22. When the switch 30 is closed, reception of a first pulse by the voice signal generator 22 causes it to emit a signal generally corresponding to or mimicking the word "back" when the signal is converted into sound. Upon reception of a second pulse, the voice signal generator 22 emits a signal generally corresponding to or mimicking the word "hit" when the signal is converted into sound.

Connected to the output of the second switch 32 is a beep signal generator 24 that generates beep signals when it receives a pulse. Connected to the output of the third switch 34 is a click signal generator 26 that generates click signals when it receives a pulse. Finally, connected to the output of the fourth switch 36 is a motion simulation signal generator 28 that sequentially generates appropriate visual display 42 signals when it receives sequential pulses.

Connected to the outputs of the voice, beep, and click signal generators 22–26 is the volume control 38 input. The volume control 38 controls the amplitude of the signal passed to it by the audible signal generators 22–26 and thereby modulates the loudness of the sounds emitted by the earphone/speaker 40. The volume control 38 is adjustable so that the user can adjust the loudness of the tones to his preference.

Connected to the output of the motion simulation signal generator 28 is the input of the visual display 42. Upon reception of appropriate signals from the motion simulation signal generator 28, the visual display 42 sequentially displays a figure going through its golf swing according to the present invention.

In FIG. 2, a golfer 44 is shown wearing the sports timing aid 8 on his belt. He has finished backswing of his golf club 46 and is about to start his foreswing to hit the golf ball 48. In using the sports timing aid 8, the golfer 44 first sets its mode to "golf swing" and addresses the ball 48. Then the golfer 44 starts the sports timing aid 8 by pushing the start/stop switch 18 on top of the sports timing aid 8. After approximately five seconds, two warning beeps are emitted by the sports timing aid 8. These two warning beeps are followed by two swing clicks. All four sounds are heard by the golfer 44 through the earphone 40. Through these audible prompts, the golfer 44 is able to establish a consistent rhythm for his golf swing, thereby improving his performance and enjoyment of the game.

As applied to the golf swing, all four prompts, i.e., the two warning beeps and the two swing clicks, are the same amount of time apart. The approximately five second delay is present in order to give the user of the sports timing aid 8 enough time to get properly situated and readdress the ball 48 after activating the sports timing aid 8 by pushing the start/stop switch 18 on top of the sports timing aid 8.

After activating the sports timing aid 8, the golfer 44 readdresses the ball 48 during the short pause and then hears two warning beeps. The first beep is a warning that the second beep is imminent. The time interval between the first and second warning beeps informs the golfer 44 as to the duration of the remaining time intervals between the second warning beep and the first swing click as well as the interval between the first and second swing clicks, as all of the time intervals between sounds are the same.

Upon hearing the second warning beep, the golfer 44 immediately begins his backswing. He continues his backswing until he hears the first swing click. When the first swing click is emitted by the sports timing aid 8, the golfer 44 is or should be at the end of his backswing and, ready to begin his foreswing. The time interval between the two warning beeps alerts the golfer 44 as to how long the time interval will be between the second warning beep and the first swing click. The golfer 44 adjusts his backswing accordingly.

At the same time that the first swing click occurs, the golfer 44 begins his foreswing. When the second swing click is emitted by the sports timing aid 8, the golfer 44 strikes the golf ball 48 at the middle of his foreswing and begins to follow through after striking the golf ball 48. The golfer 44 knows from the previous clicks, beeps, and the identical intervals of time between the sounds, how long he has from the end of his backswing to hit the golf ball 48 as the second swing click is emitted and heard.

As the golfer 44 has followed the audible prompts emitted by the sports timing aid 8, his swing is more balanced due to the equal time intervals for the crucial parts of his golf swing. As his swing improves, the golfer 44 enjoys greater performance on the golf course as the ball 48 is more consistently and properly hit down the fairway. As his performance increases, so does the golfer's 44 enjoyment of the game.

As for the golf swing, the sports timing aid 8 also has applications for tennis, especially the tennis serve. The foregoing explanation of the application of the sports timing aid 8 to golf swing is also applicable to the swing of the tennis racquet during the serve. Similarly, the same is true for bowling.

Externally, the sports timing aid 8 has several visible features. The sports timing aid 8 is highly portable and of unitary construction. Preferably, the sports timing aid 8 is worn on the belt of the golfer 44 or athlete with the earphone 40 and accompanying wire connected to the sports timing aid 8.

An on/off switch 12 is conveniently located on the side of the sports timing aid 8. The start/stop switch 18 is conveniently located on top of the sports timing aid 8. When the start/stop switch 18 is pushed, an approximately five second delay is made before the warning beeps and swing clicks are made.

At the front of the sports timing aid 8 is an adjustable rate selector 14. This adjustable rate selector 14 allows the golfer 44 to select the rate at which the warning beeps and swing clicks are emitted. In the preferred embodiment, the golfer 44 may choose from a slower rate of 52 beeps/clicks per minute to a faster rate of 72 beeps/clicks per minute. Such an adjustable rate is necessary as different golfers have different natural rhythms or frequencies to their golf swing. Ostensibly, height is the predominant factor with a taller golfer 44 having a swing that takes longer than the swing of a shorter golfer 44. However, there may be differences between the genders such that women and men of equal heights have different natural rates at which they swing their golf clubs.

The adjustable rate selector 14 changes how often the sounds or tones are emitted, with a preferred range of about 52 tones per minute to about 72 tones per minute. This range of tone-per-minute variations is chosen to easily encompass most golf swing rhythms. The adjustable rate selector 14 is at an angle to facilitate rate adjustment while the sports timing aid 8 is being worn. With usage of the aid 18 over differing periods of time and experience, each individual golfer will be able to determine for himself the most desirable rate of beep and click prompts to provide him with his maximized performance.

Located above the adjustable rate selector 14 is visual display 42 that aids the golfer 44 in immediately understanding how to use the sports timing aid 8 to improve his golf swing and to visualize the actions he must take as a golfer 44 in order to realize the benefit of the sports timing aid 8 as applied to the golf swing.

The visual display 42 displays a simple stick figure 44' holding a stick golf club 46' in its hands. The visual display figure 44' is not unlike the figure of FIGS. 4A, 4B, 4C. However, the display need not include a little stick sports timing aid 8' on the stick belt of the stick figure 44'.

When the start/stop switch 18 is pushed, the stick figure 44' of the visual display 42 goes through the golf swing as for the golfer 44 mentioned above. As the stick figure 44' does not have to adjust its grip (as the human user does when pressing the start/stop switch 18), the stick figure 44' stands ready to swing during the approximately five second delay. On the first warning beep, the stick figure 44' remains steady. On the second warning beep, the stick figure 44' begins its backswing during the time interval as set by the adjustable rate selector 14, FIG. 4A. On the first swing click, the stick figure 44' has ended its backswing and is ready to begin its foreswing, FIG. 4B. On the second swing click, the stick figure 44' of the visual display 42 is at the bottom of its foreswing, FIG. 4C. The stick figure 44' then follows through its swing, keeping its head down.

Should a golfer 44 wish to turn off the visual display 42 while golfing, a switch 36 is included with the sports timing aid 8 to turn off the visual display 42.

In the preferred embodiment, an option is incorporated into the sports timing aid 8 such that, as the two swing clicks are emitted, or instead of them, a voice sound is emitted by the sports timing aid 8 that says or mimics the word "back" when it is time for the first swing click, and says or mimics the word "hit" when it is time for the second swing click. This option is controlled by a switch 30.

All sound signal generators 22–26 used (voice, click, and beep generators) are well known in the art of electronic sound generation. The sound signal generators 22–26 emit their sounds upon receiving a signal from the adjustable clock 10. In an alternative embodiment, the sound generator switches 30–34 may be linked so that a more limited choice of sound combinations is available to the user. In addition to the switches 30–34, a volume control 38 may be added to control the loudness of the generated sounds.

When the sports timing aid 8 is in the golf swing mode, the start/stop switch 18 is pressed to initiate the sequence. When the start/stop switch 18 is pushed, the sports timing aid 8 waits approximately five seconds until emitting the first warning beep. The golf swing cycle is then performed as explained above. After the golf swing cycle is completed, no sounds or tones are emitted until the start button is pushed again.

When the voice switch is selected, the "back" and "hit" word or mimicry sounds are emitted by the sports timing aid 8 at the same time as are the first and second swing clicks, respectively.

When the continuous beat switch position is selected, the start/stop switch 18 acts as a toggle switch and is pushed to start the tones if the tones are not being emitted, and pushed again to stop the tones if the tones are being emitted. In this way, the sports timing aid 8 can be "on", but not running. Should the wearer or user of the sports timing aid 8 wish to continue to wear the aid 8 while pausing in his sport, such as when a jogger or runner talks with a neighbor, then the tones can be stopped without having to turn off the sports timing aid 8.

The invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A unitary and portable sports timing aid comprising:

an adjustable clock for producing a series of clock signals at selectable timed intervals;

at least one sound signal generator that is coupled to, controlled by, and operates in response to said clock signals for producing a sequence of sound signals, said sound signal generator including a voice signal generator that produces signals that mimic spoken words; and an audible sound converter coupled to said sound signal generator for converting said sound signals to audible sounds.

2. The sports timing aid of claim 1, wherein said adjustable clock is selectably variable form about 52 clock cycles per minute to about 72 clock cycles per minute.

3. The sports timing aid of claim 1 wherein at least one said sound signal generator comprises a beep signal generator.

4. The sports timing aid of claim 1 wherein at least one said sound signal generator comprises a click signal generator.

5. The sports timing aid of claim 1 wherein said at least one sound signal generator further comprises a beep signal generator and a click signal generator, wherein:

upon activation of the sports timing aid, a delay of approximately five seconds is followed by two warning beeps, two swing clicks, an audible sound mimicking the word "back" simultaneous with the first of said two swing clicks, and an audible sound mimicking the word "hit" simultaneous with the second of said two swing clicks.

6. The sports timing aid of claim 1 wherein activation of the sports timing aid generates a short sequence of sounds, said short sequence of sounds terminating without further user intervention.

7. The unitary and portable sports timing aid of claim 1 further comprising a switch allowing the sports timing aid to generate short sequence of sounds upon activation or a continuous sequence of sounds upon activation, said short sequence of sounds terminating without further user intervention.

8. The sports timing aid of claim 1 further comprising switches allowing a user to control transmission of a sound signal from at least one of said signal generators of said sound signal generator.

9. The sports timing aid of claim 1 further comprising a volume control connected to at least one said sound signal generator for controlling loudness of generated sound.

10. The sports timing aid of claim 1 further comprising:

a motion simulation signal generator coupled to said adjustable clock, said motion simulation signal generator driving a visual display.

11. The sports timing aid of claim 10, wherein said visual display comprises a sequence of images portraying use of the sports timing aid for golf.

12. A lightweight unitary compact portable sports timing aid, adapted to be worn by the user, comprising:

an adjustable clock for producing and maintaining a series of clock signals with constant time intervals between adjustments to said clock;

selector means coupled to said clock for selecting the rate of said clock signals by selecting said time interval;

a beep signal generator coupled to said adjustable clock for receiving at least some of said clock signals and for producing a series of beep signals;

a click signal generator coupled to said adjustable clock for receiving at least some of said clock signals and for producing a series of click signals;

an audible sound converter coupled to said signal generators for producing a series of sound signals audible to the user; and a timing sequence controller, coupled to an output of said adjustable clock, for receiving at least some of said series of clock signals, and coupled to inputs of all of said signal generators for controlling the occurrence and sequence of transmission of said clock signals to each of said signal generators.

13. The sports timing aid of claim 12 including a voice signal generator that produces signals that mimic spoken words, said voice signal generator coupled to said adjustable clock for receiving at least some of said clock signals and for producing a series of voice signals.

14. The sports timing aid of claim 12, wherein activation of the sports timing aid generates a short sequence of sounds, said short sequence of sounds terminating without further user intervention.

15. The sports timing aid of claim 12 including:

a motion simulation signal generator coupled to said adjustable clock for receiving at least some of said clock signals and for producing a series of motion simulation signals, and a visual display coupled to said motion simulation signal generator for receiving said series of motion simulation signals and visually displaying simulated motions, said visual display comprising a sequence of images portraying use of the sports timing aid.

16. The sports timing aid of claim 15 including a voice signal generator that produces signals that mimic spoken words, said voice signal generator coupled to said adjustable clock or receiving at least some of said clock signals and for producing a series of voice signals.

17. The sports timing aid of claim 16 including selectively operable on-off switch means coupled to the inputs of each of said signal generators for selectably disabling any one or more of said signal generators.

18. A lightweight unitary compact portable sports timing aid, adapted to be worn by the user, comprising:

an adjustable clock for producing and maintaining a series of clock signals with constant time intervals between adjustments to said clock;

selector means coupled to said clock for selecting the rate of said clock signals by selecting said time interval;

a beep signal generator coupled to said adjustable clock for receiving at least some of said clock signals and for producing a series of beep signals;

a click signal generator coupled to said adjustable clock for receiving at least some of said clock signals and for producing a series of click signals;

an audible sound converter coupled to said signal generators for producing a series of sound signals audible to the user;

a motion simulation signal generator coupled to said adjustable clock for receiving at least some of said clock signals and for producing a series of motion simulation signals;

a visual display coupled to said motion simulation signal generator for receiving said series of motion simulation signals and visually displaying simulated motions;

a voice signal generator that produces signals that mimic spoken words, said voice signal generator coupled to said adjustable clock for receiving at least some of said clock signals and for producing a series of voice signals;

selectively operable on-off switch means coupled to the inputs of each of said signal generators for selectably disabling any one or more of said signal generators; and a timing sequence controller, coupled in output relationship to said adjustable clock for receiving at least some of said series of clock signals, and coupled in input relationship to all of said signal generators for controlling the occurrence and sequence of transmission of said clock signals to each of said signal generators.

19. A unitary and portable sports timing aid comprising:

an adjustable clock for producing a series of clock signals at selectable timed intervals;

a sound signal generator that is coupled to, controlled by, and operates in response to said clock signals for producing a sequence of sound signals, said sound signal generator comprising a beep signal generator, and a click signal generator, and a voice signal generator wherein:

upon activation of the sports timing aid, a delay of approximately five seconds is followed by two warning beeps, two swing clicks, an audible sound mimicking the word "back" simultaneous with the first of said two swing clicks, and an audible sound mimicking the work "hit" simultaneous with the second of said two swing clicks; and an audible sound converter coupled to said sound signal generator for converting said sound signals to audible sounds.

20. The sports timing aid of claim 19 further comprising a volume control connected to at least one said sound signal generator for controlling loudness of generated sound.

21. The sports timing aid of claim 19 further comprising:

a motion simulation signal generator coupled to said adjustable clock, said motion simulation signal generator driving a visual display.

22. The sports timing aid of claim 21, wherein said visual display comprises a sequence of images portraying use of the sports timing aid for golf.

* * * * *